United States Patent [19]

Asano et al.

[11] Patent Number: 4,649,880

[45] Date of Patent: Mar. 17, 1987

[54] APPARATUS FOR THROTTLE VALVE CONTROL

[75] Inventors: Hiroyuki Asano; Shinji Katayose, both of Tokyo; Hideaki Inoue, Kanagawa; Akira Takei, Kanagawa; Minoru Tamura, Kanagawa, all of Japan

[73] Assignee: Nissan Motor Co., Ltd., Yokohama, Japan

[21] Appl. No.: 843,279

[22] Filed: Mar. 24, 1986

[30] Foreign Application Priority Data

Mar. 26, 1985 [JP] Japan ..... 60-59612

[51] Int. Cl.[4] ..... F02D 41/02

[52] U.S. Cl. ..... 123/399; 123/198 DB

[58] Field of Search ..... 123/361, 395, 397, 399, 123/403, 198 DB

[56] References Cited

U.S. PATENT DOCUMENTS 4,401,078 8/1983 Kato et al. ..... 123/403

4,424,782 1/1984 Emmerich ..... 123/198 DB 4,555,762 11/1985 Ohgami et al. ..... 123/198 DB

FOREIGN PATENT DOCUMENTS 38448 3/1979 Japan ..... 123/397

*Primary Examiner*—William A. Cuchlinski, Jr.

*Attorney, Agent, or Firm*—Schwartz, Jeffery, Schwaab, Mack, Blumenthal & Evans

[57] ABSTRACT

An apparatus for controlling movement of a throttle valve in response to a change in the position of an accelerator pedal. The apparatus includes a control circuit powered from a power source through an ignition switch for determining a value corresponding to a setting of the position of the throttle valve. A throttle actuator is connected to the control circuit for moving the throttle valve to the determined setting. A device is provided to retain the control circuit powered from the power source until the throttle actuator returns the throttle valve to its closed position after the ignition switch is turned off.

12 Claims, 6 Drawing Figures

APPARATUS FOR THROTTLE VALVE CONTROL

BACKGROUND OF THE INVENTION

This invention relates to an apparatus for controlling movement of a throttle valve in response to a change in the position of an accelerator pedal.

In order to meter the amount of air to an internal combustion engine, a variable positionable throttle valve is situated within a throttle chamber connected to the engine induction passage. Normally, a mechanical link mechanism is provided to couple the throttle valve to an accelerator pedal or other accelerator device such as an accelerator lever in a manner to move the throttle valve in response to movement of the accelerator pedal. In order to improve the responsiveness of the movement of the throttle valve with respect to the movement of the accelerator pedal, it has been proposed to substitute an electrical servo control system for the mechanical link mechanism. Such an electrical servo control system includes a potentiometer which converts the movement of the accelerator pedal into a corresponding electric signal which is electrically processed to drive an actuator which thereby moves the throttle valve to a position corresponding to the new position of the accelerator pedal. The servo control system is powered from a vehicle battery through an ignition switch. Consequently, the servo control system stops its operation immediately when the driver turns the ignition switch off in order to bring the engine to a stop.

The throttle valve is urged toward its closed position by a return spring having a relatively great resilient force. If the driver turns the ignition switch off while depressing the accelerator pedal, the throttle valve will return rapidly to its closed position into abutment against the valve rest, causing the throttle rest to bit the throttle valve and/or to be subject to failure.

Therefore, the present invention provides an improved throttle valve control apparatus which can prevent the throttle valve from moving rapidly into abutment against the valve rest under a great force of the return spring when the driver turns the ignition witch off while depressing the accelerator device.

SUMMARY OF THE INVENTION

There is provided, in accordance with the present invention, an apparatus for use with an internal combustion engine having an ignition switch, an accelerator device and a throttle valve for controlling movement of the throttle valve in response to a change in the position of the accelerator device. The apparatus comprises a signal dource for generating an electrical signal indicative of the position of the accelerator pedal. A control circuit is powered from a power source through the ignition switch for determining a value corresponding to a setting of the position of the throttle valve in response to the accelerator device position indicative signal. A throttle actuator is connected to the control circuit for moving the throttle valve to the determined setting. The control circuit includes means for retaining the control circuit powered from the power source until the throttle actuator returns the throttle valve to its closed position after the ignition switch is turned off.

BRIEF DESCRIPTION OF THE DRAWINGS

This invention will be described in greater detail by reference to the following description taken in connection with the accompanying drawings, in which like reference numerals refer to the same or corresponding parts, and wherein.

DETAILED DESCRIPTION OF THE PREFERRED EMBODIMENTS

Figure 1:
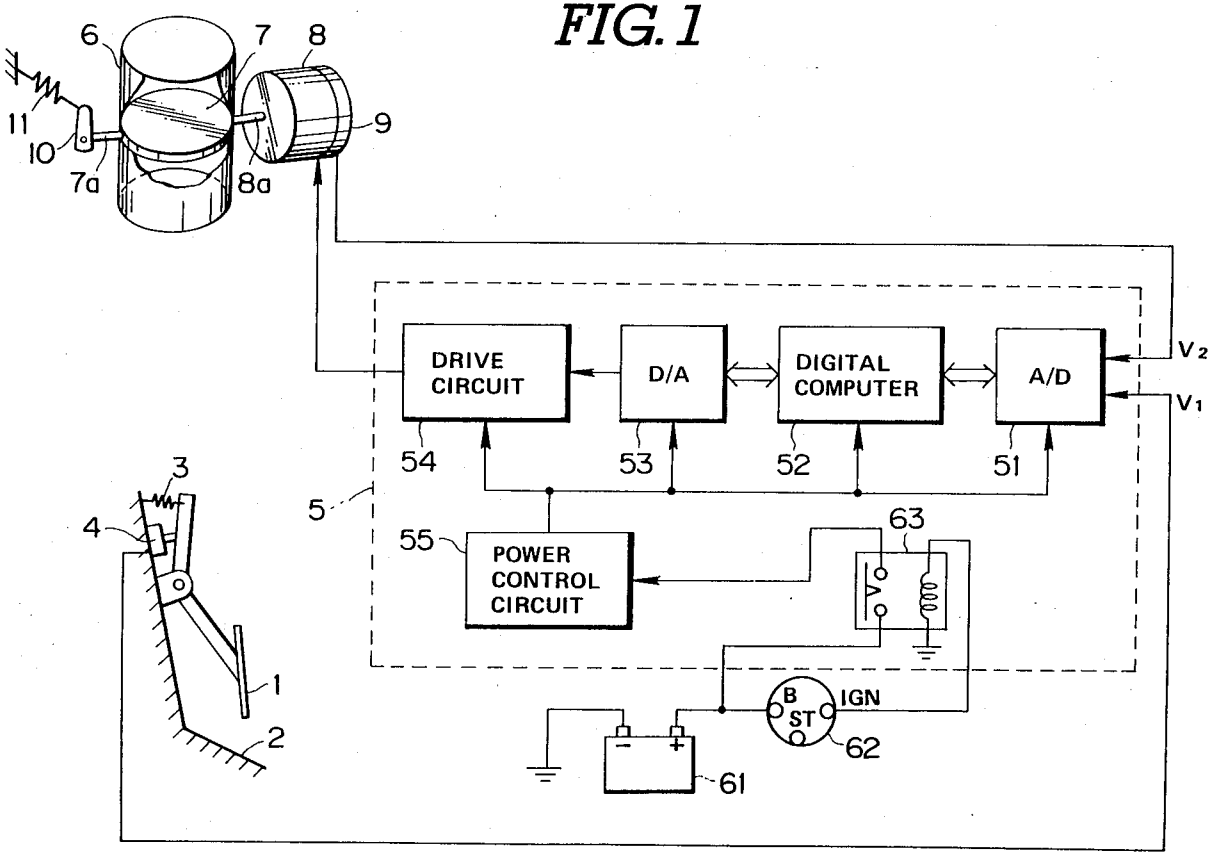
FIG. 1 is a schematic block diagram showing one embodiment of a throttle valve control apparatus made in accordance with the present invention.

With reference to the drawings and in particular to FIG. 1, there is shown a schematic block diagram of an automobile throttle valve control system embodying the present invention. In FIG. 1, the reference numeral 1 designates an accelerator pedal which is pivoted on an automobile floor panel 2. A return spring 3 is placed between the accelerator pedal 1 and the floor panel 2 to urge the accelerator pedal 1 to its fully released or idle position. An accelerator pedal position sensor 4, mounted on the floor panel 2, generates an analog signal V1 corresponding to the amount L of depression of the accelerator pedal 1. The accelerator pedal position sensor 4 includes a potentiometer connected between a voltage source and electrical ground. The resistance of the potentiometer is a function of the extent to which the accelerator pedal 1 is depressed. The wiper arm of the potentiometer is operatively connected to the accelerator pedal in a manner to change the resistance value of the potentiometer as the accelerator pedal 1 moves between its fully released and depressed positions.

A variable positionable throttle valve 7, mounted as for rotation with a throttle shaft *7a*, is situated within a throttle chamber 6 and is effective for controlling the flow of air to the engine. A bi-directional control motor 8 has a motor shaft *8a* which is drivingly coupled to the throttle shaft *7a*. For example, the control motor 8 may be a servo motor. The control motor 8 functions to vary the position of the throttle valve 7 in such a manner as described later. A throttle valve position sensor 9, associated with the control motor 11, generates an analog signal V2 corresponding to the degree of opening of the throttle valve 7 in terms of the angular position of the control motor 8. The throttle valve position sensor 9 may includes a potentiometer which has a wiper arm drivingly connected to the motor shaft. In addition, the throttle valve position sensor may include a potentiometer which has a wiper arm drivingly connected to the throttle shaft for generating a voltage signal corresponding to the degree of opening of the throttle valve. A return spring 11 is provided between a lever 10 secured on the throttle shaft *7a* and the engine body to urge the throttle shaft *7a* in a direction closing the throttle valve 7.

The sensor signals V1 and V2 are applied to a control circuit 5. The control circuit 5 includes an analog-to-digital converter 51, a digital computer 52, a digital-to-analog converter 53 and a drive circuit 54. The analog-to-digital converter 51 receives the analog signals V1 and V2 from the accelerator-pedal and throttle-valve position sensors 4 and 9 and converts the received signals into corresponding digital signals for application to the digital computer 52. The digital computer shall be regarded as including a central proccessing unit, a memory and a timer. The memory contains the program for operating the central processing unit and further contains appropriate data in look-up tables used in calculating appropriate values for the position of the throttle valve 2. The look-up data may be obtained experimentally or derived empirically. The central processing unit may be programmed in a known manner to interpolate between the data at different entry points if desired. The digital computer 52 determines the required new setting, at a given time, of the throttle valve position. The actual setting of the throttle valve 7 is accomplished with the control motor 8 and its drive circuit 54. Control words specifying a desired throttle valve position are periodically transferred by the central processing unit to the digital-to-analog converter 53. The digital-to-converter 53 converts the transferred information into analog form and applies a control signal to the drive circuit 54 for controlling the direction and degree of motion of the control motor 8.

The control circuit 5 also includes a power control circuit 55 for application of power to the respective circuits 51 to 54. The power control circuit 55 is connected through an ignition switch 62 to a power source such for example as a vehicle battery 61. The ignition switch 62 is operatively associated with a timer circuit 63 which connects the power control circuit 55 to the vehicle battery 61 immediately when the ignition switch 62 is turned on and disconnects the power control circuit 55 from the vehicle battery 61 a predetermined time after the ignition switch is turned off. The length of the time during which the timer circuit 63 connects the power control circuit 55 to the vehicle battery 61 after the ignition switch is turned off is somewhat longer than the time required for the control circuit 5 to return the throttle valve 7 to its closed position after the accelerator pedal 1 is released. For example, the time may be 5 or 6 seconds.

Figure 2:
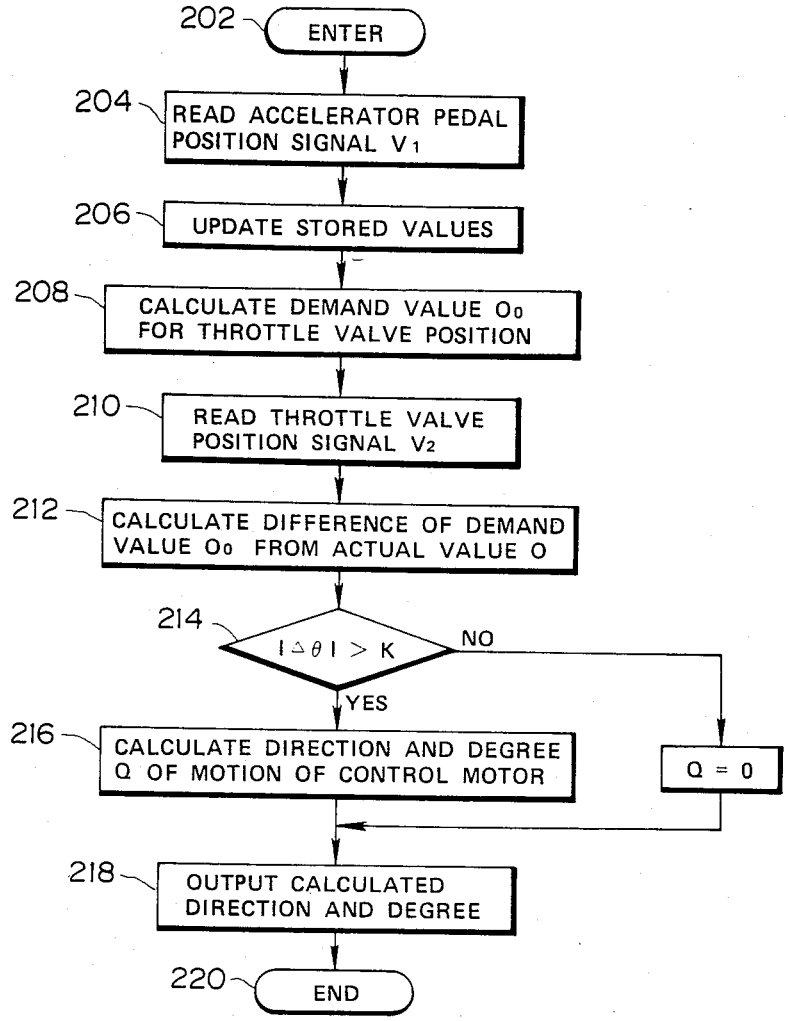
FIG. 2 is a flow diagram showing the programming of the digital computer used in the apparatus of FIG. 1.
Figure 3:
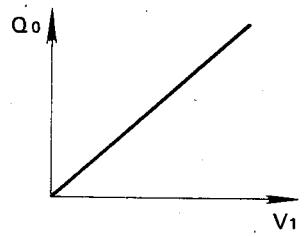
FIGS. 3 and 4 are representations of values produced by the read only memory of the digital computer.

FIG. 2 is a flow diagram of the programming of the digital computer used in the control circuit 5. The computer program is entered at the point 202 at predetermined time intervals, or at appropriate times, or in synchronism with engine rotation. At the point 204 in the program, the accelerator pedal position signal V1 is converted by the analog-to-digital converter 51 into digital form and read into the computer memory at the first location. The computer memory has n locations for sequential storage of n values for the accelerator pedal position signal V1 read in respective cycles of execution of the program. Following this, the central processing unit updates the accelerator pedal position signal values stored at the respective locations. Thus, at the point 206, each of the accelerator pedal position values is shifted from one (the i-th) location to the next (i+1-th) location. At the point 208 in the program, the central processing unit calculates a demand value $\theta o$ for the throttle valve position from a relationship programmed into the computer. This relationship is shown in FIG. 3 and it defines throttle valve demand value $\theta o$ as a function of accelerator pedal position signal V1.

At the point 210 in the program, the throttle valve position signal V2 is converted by the analog-to-digital converter 51 into digital form and read into the computer memory as an actual value $\theta$ for throttle valve position. At the point 212, the center processing unit calculates a differences $\Delta\theta$ of the throttle valve position actual value $\theta$ from the throttle valve position demand value $\theta o$.

Figure 4:
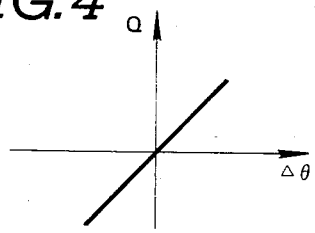

At the following point 214 in the program, a determination is made as to whether or not the absolute value $|\Delta\theta|$ of the calculated difference $\Delta\theta$ is greater than a predetermined value K which is stored in the computer memory to provide a play in response to a predetermined range of movement of the accelerator pedal 1. If the answer to this question is "yes", then the program proceeds to the point 216 where the central processing unit calculates the direction and degree Q of motion of the control motor 8 required to bring the throttle valve 7 to a new setting. The direction in which the control motor 8 is to rotate is determined as a first direction moving the throttle valve in an opening direction when the signal of the calculated difference $\Delta\theta$ is positive and as a second direction closing the throttle valve when the calculated difference $\Delta\theta$ is negative. The degree Q of motion of the control motor 8 is determined in direct proportion to the absolute value $|\Delta\theta|$ of the calculated difference $\Delta\theta$, as shown in FIG. 4. At the point 218, the calculated new setting information is transferred to the digital-to-analog converter 53 which thereby produces a control signal to the drive circuit 54 for controlling the direction and degree of motion of the control motor 8. Following this, the program proceeds to the end point 220.

If the absolute value $|\Delta\theta|$ is equal to or smaller than the predetermined value K, then the program proceeds from the determination point 214 to the point 222. At the point 122, the central processing unit sets the required degree Q of motion of the control motor 8 at zero. Following this, the program proceeds to the end point 218. In other words, the throttle valve 7 remains at the existing position when the absolute value $|\Delta\theta|$ is equal to or greater than the predetermined value K.

The timer circuit 63 retains the connection of the power control circuit 55 to the vehicle battery 61 for application of power to the respective circuits 51 to 54 after the ignition switch 62 is turned off. Consequently, the control circuit 5 can operate to return the throttle valve 7 to its closed position if thd driver releases the accelerator pedal 1 within the predetermined time. In this manner, the present invention can avoid the occurrence of the problems attendant on the conventional throttle valve control apparatus.

It is to be noted that the time circuit 62 may be removed and replaced with a switching circuit which can interrupt the connection between the power control circuit 55 and the vehicle battery 61 when the throttle valve arrives at its closed position. Such a switching circuit may comprise a throttle switch operable to provide a control signal when the throttle valve is at its closed position, and a circuit responsive to the control signal for disconnecting the power control circuit 55 from the vehicle battery 61. In addition, the timer circuit 62 may be associated with the switching circuit in order to prevent application of power to the control circuit 5 after the engine comes to a stop when the throttle switch is subject to failure.

As described above, the control circuit remains powered for a predetermined time required to return the throttle valve to its closed position after the driver turns the ignition switch off to bring the engine to a stop. It is, therefore, possible to prevent the throttle valve from rotating rapidly into abutment against the valve rest at the closed position under a great force of the return spring even if the driver turns the ignition switch off while depressing the accelerator pedal. According to this embodiment, the throttle valve can return gradually to its closed position under the control of the control circuit.

Figure 5:
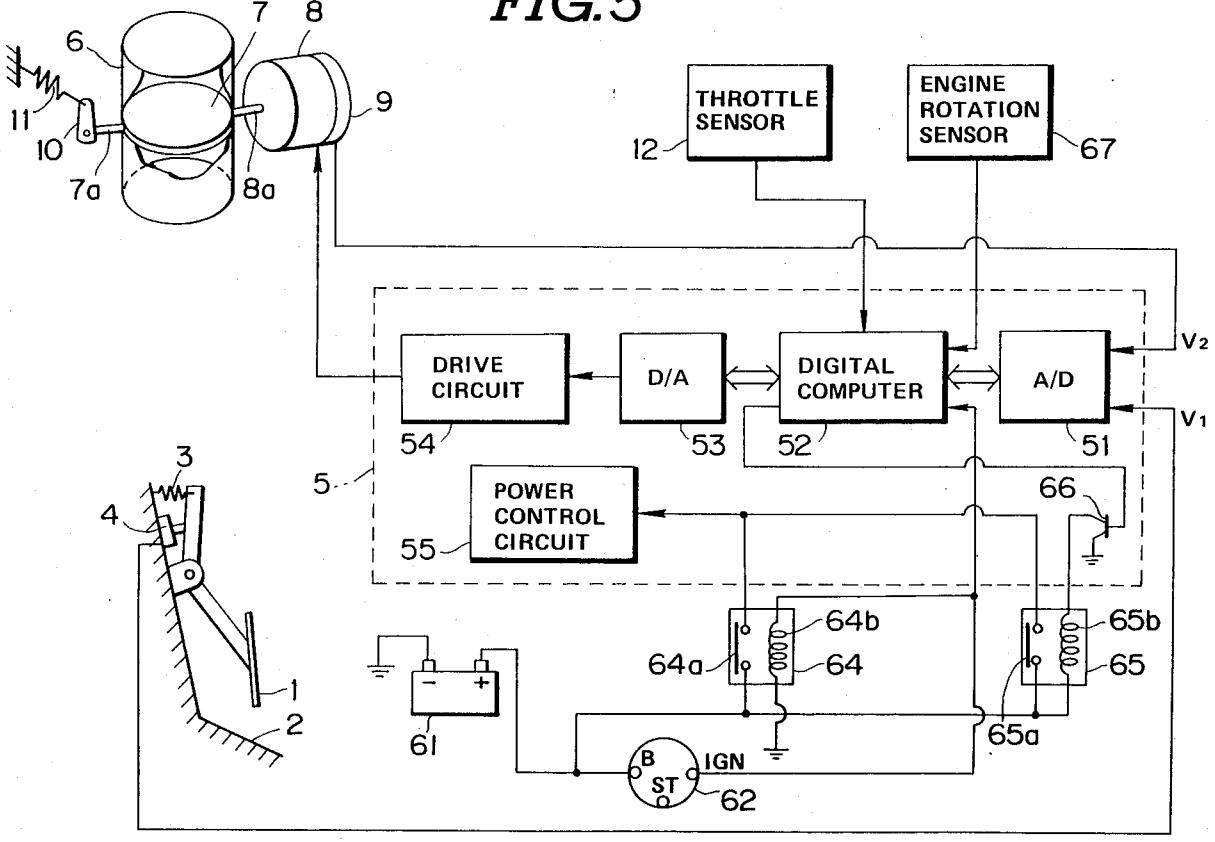
FIG. 5 is a schematic block diagram showing a second embodiment of the present invention.

Referring to FIG. 5, there is illustrated a second embodiment of the throttle valve control apparatus. In this embodiment, the power control circuit 55 is connected to the vehicle battery 61 through a relay controlled switch 64*a* which is controlled by a relay coil 64*b*. The relay coil 64*b* is energized to close the relay controlled switch 64*a* only when the ignition switch 62 is on. The power control circuit 55 is also connected to the vehicle battery 61 through a relay controlled switch 65*a* which is controlled by a relay coil 65*b*. The relay coil 65*b* is connected at its one end to the vehicle battery 61. The other end of the relay coil 65*b* is connected to the collector electrode of a switching transistor 66 which has an emitter electrode connected to electrical ground and a base electrode connected to receive a transistor control signal from the digital computer 52.

The digital computer 52 changes the transistor control signal to a high level to trigger the transistor 66 into its conduction state when the ignition switch 62 is turned on. This causes energization of the relay coil 65*b* to close the relay controlled switch 65*a* so as to connect the power control circuit 55 to the vehicle battery 61. The digital computer 55 changes the transistor control signal to a low level to turn the transistor 66 off a predetermined time after the ignition switch 62 is turned off. This causes deenergization of the relay coil 65*b* to open the relay controlled switch 65*a* so as to disconnect the power control circuit 55 from the vehicle battery 61. The control circuit 5 can return the throttle valve 7 to its closed position within the predetermined time in the same manner as described in connection with the first embodiment. The relay 65 is effective to retain the connection of the power control circuit 55 to the vehicle battery 61 in spite of a breakage of the line on which an ignition switch position representative signal is fed to the digital computer when the engine is operating in order.

The digital computer 52 is also connected to receive a sensor signal from an engine rotation sensor 67 when the engine is rotating. For example, the engine rotation sensor 67 may be taken in the form of an ignition pulse sensor which can sense the engine running by detecting the presence of ignition pulses to the engine ignition device. The digital computer 52 also includes a counter for use in measuring the predetermined time during which the digital computer 55 retains the transistor control signal at its high level when the ignition switch 62 is turned off.

Figure 6:
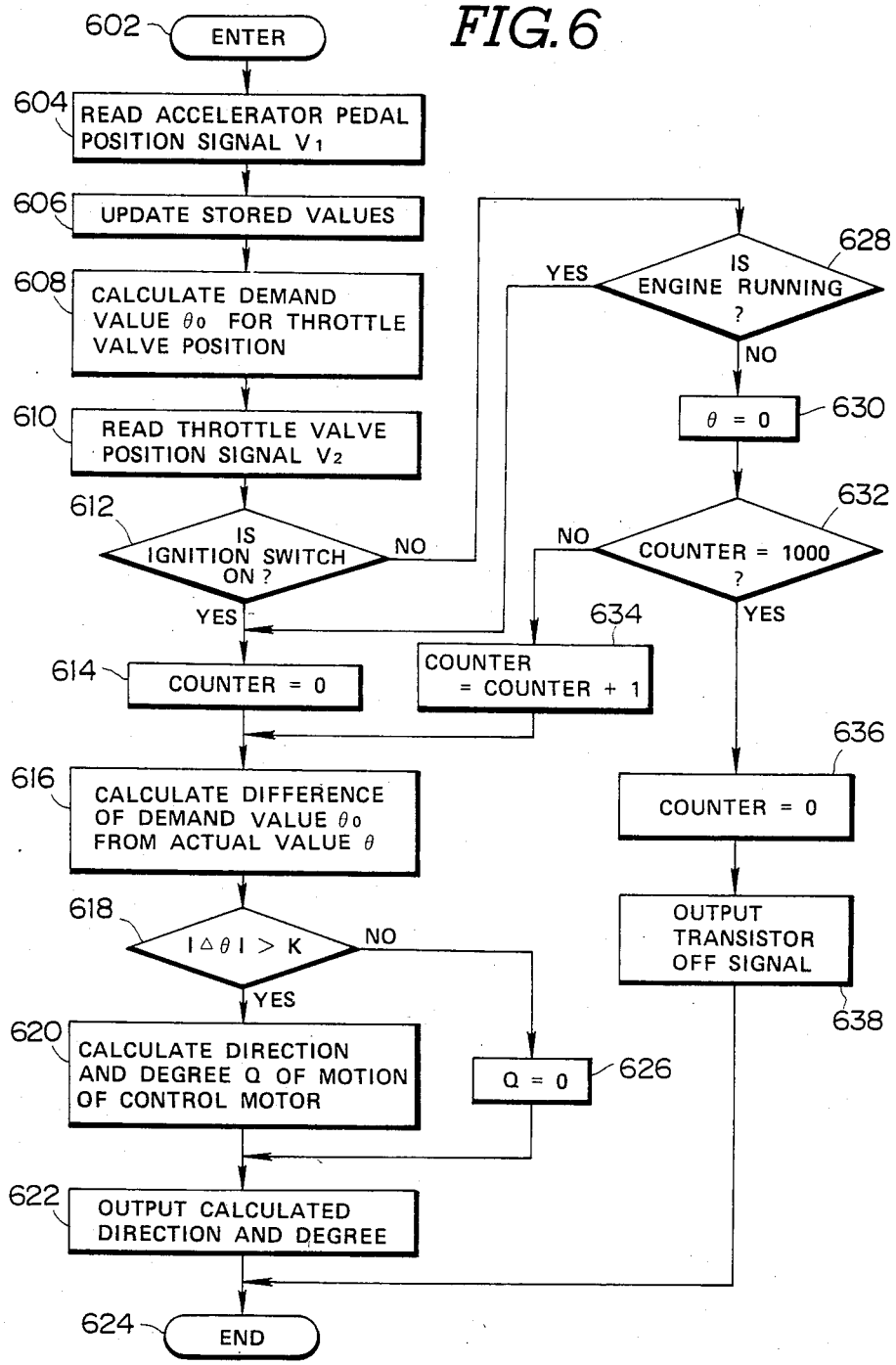
FIG. 6 is a flow diagram showing the programming of the digital computer used in the apparatus of FIG. 5.

FIG. 6 is a flow diagram of the programming of the digital computer used in the control circuit of FIG. 5. The compute program is entered at the point 602 at predetermined time intervals, or at appropriate times, or in synchronism with engine rotation. At the point 604 in the program, the accelerator pedal position signal V1 is converted by the analog-to-digital converter 51 into digital form and read into the computer memory at the first location. The computer memory has n locations for sequential storage of an values for the accelerator pedal position signal V1 read in respective cycles of execution of the program. Following this, the central processing unit updates the accelerator pedal position signal values stored at the respective memory locations. Thus, at the point 606, each of the accelerator pedal position values is shifted from one location to the next location. At the point 608 in the program, the central processing unit calculates a demand value $\theta o$ for the throttle valve position in the same manner as escribed in connection with the point 208 of FIG. 2. At the point 610 in the program, the throttle valve position signal V2 is converted by the analog-to-digital converter 51 into digital form and read into the computer memory as an actual value 0 for throttle valve position.

At the point 612 in the program, a determination is made as to whether or not the ignition switch 62 is on. If the answer to this question is "yes", then the program proceeds to the point 614 where the counter is reset to zero. Following this, the program proceeds to the point 616 where the central processing unit calculates a difference $\Delta\theta$ of the throttle valve position actual value $\theta$ from the throttle valve position demand value $\theta o$.

At the following point 618 in the program, a determination is made as to whether or not the absolute value $|\Delta\theta|$ of the calculated difference $\Delta\theta$ is greater than a predetermined value K which is stored in the computer memory to provide a play in response to a predetermined range of movement of the accelerator pedal 1. If the answer to this question is "yes", then the program proceeds to the point 620 where the central processing unit calculates the direction and degree Q of motion of the control motor 8 required to bring the throttle valve 7 to a new setting in the same manner as described in connection with the point 216 of FIG. 2. At the point 622 in the program, the calculated new setting information is transferred to the digital-to-analog converter 53 which thereby produces a control signal to the drive circuit 54 for controlling the direction and degree of motion of the control motor 8. Following this, the program proceeds to the end point 624.

If the question inputted at the point 618 is "no", then the program proceeds to the point 626 where the central processing unit sets the required degree Q of motion of the control motor 8 at zero. Following this, the program proceeds to the end point 624. That is, the control circuit 5 retains the throttle valve 7 at its existing position when the absolute value $|\Delta\theta|$ is equal to or greater than the predetermined value K.

If the ignition switch is off, then the program proceeds from the point 612 to the point 628. At the point 628, a determination is made as to whether or not the engine is rotating. This determination is made based upon the output of the engine rotation sensor 67. The engine rotation sensor 67 may be a sensor capable of sensing the presence of ignition pulses to the engine ignition device, in which case, the central processing unit determines an engine running condition only when ignition pulses are generated to the engine ignition device. If the answer to this question is "yes", then it means that the digital computer 52 receives no signal from the ignition switch 62 in spite of the fact that the engine is operating, that is, a failure occurs on the line connecting the ignition switch 62 to the digital computer 52 and the program proceeds to the point 614. If the answer to the question inputted at the point 628, then the program proceeds to the point 630 where the central processing unit sets the throttle valve position demand value $\theta o$ at zero. Following this, the program proceeds to a determination point 632. This determination is as to whether or not the count of the counter is 1000. If the answer to this question is "no", then it means that the predetermined time does not elapse still after the ignition switch is turned off and the program proceeds to the point 634 where the counter is advanced by one step. Following this, the program proceeds to the point 616.

If the answer to the question inputted at the point 632 is "yes", it means that the predetermined time elapses after the ignition switch 62 is turned off and the program proceeds to the point 636 where the counter is reset to zero and then to the point 638 where the transistor control signal is changed to its low level so as to disconnect the power control circuit 55 from the vehicle battery 61. Following this, the program proceeds to the end point 624.

The relay 64 is turned off immediately when the ignition switch 62 is turned off. The relay 65 remains at its on condition connecting the power control circuit 55 to the vehicle battery 61 for a predetermined time after the ignition switch 62 is turned off. When the engine comes to a stop, the throttle valve position demand value Oo is set at zero so as to return the throttle valve 7 to its closed position within the predetermined time which corresponds to a predetermined count of the counter. When the counter accumulates a predetermined count corresponding to the predetermined time, the transistor 63 is turned into its non-conductive condition turning the relay 65 off so as to interrupt power application to the power control circuit 55. The length of the time during which the counter accumulates the predetermined count may be somewhat longer than the time required for the control circuit 5 to return the throttle valve 7 from its fully open position to its fully closed position. Alternatively, the control circuit 5 may be arranged to turn the transistor 66 off when the throttle valve 7 arrives at its closed position. In this case, the digital computer 52 is connected to a throttle position sensor 12 which is associated with the throttle shaft 7*a* for generating a signal when the throttle valve 7 is at its closed position. The digital computer 52 is arranged to change the transistor control signal to its low level, causing the transistor 66 to change into the non-conductive position, in response to the signal from the throttle position sensor 12.

Although the engine rotation sensor 67 has been described as sensing ignition pulses to the engine ignition device, it is to be noted that the engine rotation sensor is not limited in any way to such an arrangement. For example, the engine rotation sensor may be arranged to sense engine rotating conditions in response to crankshaft position pulses generated from a crankshaft position sensor, oil pressure, alternator output voltage, or the like.

As described above, the control circuit remains powered for a predetermined time required to return the throttle valve to its closed position after the driver turns the ignition switch off to bring the engine to a stop. It is, therefore, possible to prevent the throttle valve from rotating rapidly into abutment against the valve rest at the closed position under a great force of the return spring even if the driver turns the ignition switch off while depressing the accelerator pedal and also even if the driver remains depressing the accelerator pedal after the engine comes to a stop. According to this embodiment, the throttle valve can return gradually to its closed position under the control of the control circuit. In addition, the control circuit remains powered to permit the driver to drive the vehicle to a place for repair if the line on which an ignition switch position representative signal is fed to the control circuit is subject to failure when the engine is operating in order.

While the present invention has been described in conjunction with specific embodiments thereof, it is evident that many alternatives, modifications and variations will be apparent to those skilled in the art. Accordingly, it is intended to embrace all alternatives, modifications and variations that fall within the scope of the appended claims.

What is claimed is:

1. An apparatus for use with an internal combustion engine having an ignition switch, an accelerator device and a throttle valve for controlling movement of said throttle valve in response to a change in the position of said accelerator device, comprising:

a signal source for generating an electrical signal indicative of the position of said accelerator device;

a control circuit powered from a power source through the ignition switch for determining a value corresponding to a setting of the position of said throttle valve in response to said accelerator device position indicative signal;

a throttle actuator connected to said control circuit for moving said throttle valve to said determined setting; and said control circuit including means for retaining said control circuit powered from said power source until said throttle actuator returns said throttle valve to its closed position after said ignition switch is turned off.

2. The apparatus as claimed in claim 1, wherein said control circuit means retains said control circuit powered from said power source for a predetermined time after said ignition switch is turned off.

3. The apparatus as claimed in claim 2, wherein said control circuit means includes a circuit for connecting said control circuit to said power source when said ignition switch is on, said circuit disconnecting said control circuit from said power source a predetermined time after said ignition switch is turned off.

4. The apparatus as claimed in claim 1, wherein said control circuit means includes a second signal source for generating a signal when said throttle valve arrives at its closed position, and means responsive to the signal from said second signal source for disconnecting said control circuit from said power source.

5. The apparatus as claimed in claim 1, wherein said control circuit includes means for retaining said control circuit powered from said power source when said engine is running.

6. The apparatus as claimed in claim 1, wherein said control circuit includes means for zeroing said value corresponding to a setting of the position of said throttle valve when said ignition switch is off.

7. The apparatus as claimed in claim 1, wherein said control circuit means includes:

a first switching circuit for connecting said control circuit to said power source when said ignition switch is on, said first switching circuit disconnecting said control circuit from said power source when said ignition switch is off;

a second switching circuit for connecting said control circuit to said power source when said ignition switch is on, said second switching circuit disconnecting said control circuit from said power source in response to a control signal; and means for generating the control signal to said second switching circuit a predetermined time after said ignition switch is turned off.

8. The apparatus as claim in claim 7, wherein said control circuit includes means for retaining said control circuit powered from said power source when said engine is running.

9. The apparatus as claimed in claim 7, wherein said control circuit includes means for zeroing said value corresponding to a setting of the position of said throttle valve when said ignition switch is off.

10. The apparatus as claimed in claim 1, wherein said control circuit means includes:

a first switching circuit for connecting said control circuit to said power source when said ignition switch is on, said first switching circuit disconnecting said control circuit from said power source when said ignition switch is off;

a second switching circuit for connecting said control circuit to said power source when said ignition witch is on, said second switching circuit disconnecting said control circuit from said power source in response to a control signal; and means for generating the control signal to said second switching circuit when said throttle valve arrives at its closed position.

11. The apparatus as claimed in claim 10, wherein said control circuit includes means for retaining said control circuit powered from said power source when said engine is running.

12. The apparatus as claimed in claim 10, wherein said control circuit includes means for zeroing said value corresponding to a setting of the position of said throttle valve when said ignition switch is off.

* * * * *